United States Patent [19]

de la Haye

[11] Patent Number: 4,625,424

[45] Date of Patent: Dec. 2, 1986

[54] QUICK LEVELING APPARATUS

[76] Inventor: Cornelis F. de la Haye, Gevers Deynootweg 590, 2686 BS 'S-Gravenhage, Netherlands

[21] Appl. No.: 687,515

[22] Filed: Dec. 28, 1984

[51] Int. Cl.[4] ..... A47B 9/10

[52] U.S. Cl. ..... 33/367; 248/649

[58] Field of Search ..... 248/654, 631, 188.2, 248/550, 649; 137/625.47; 251/321, 77; 33/365, 367

[56] References Cited

U.S. PATENT DOCUMENTS 2,956,761 10/1960 Weber ..... 248/550
3,310,263 3/1967 Cavanaugh ..... 248/649
3,768,766 10/1973 Bain .

FOREIGN PATENT DOCUMENTS 558873 4/1957 Belgium ..... 246/651
1036485 8/1958 Fed. Rep. of Germany .

*Primary Examiner*—William D. Martin, Jr.
*Attorney, Agent, or Firm*—Jacobs & Jacobs

[57] ABSTRACT

Apparatus for Levelling a surface, such as a table, includes several bellows containing a fluid connected to the surface, conduits connecting the bellows together and a control valve for connecting or disconnecting the conduits, the control valve being located in a chamber and being separated from an actuator by a diaphragm.

10 Claims, 5 Drawing Figures

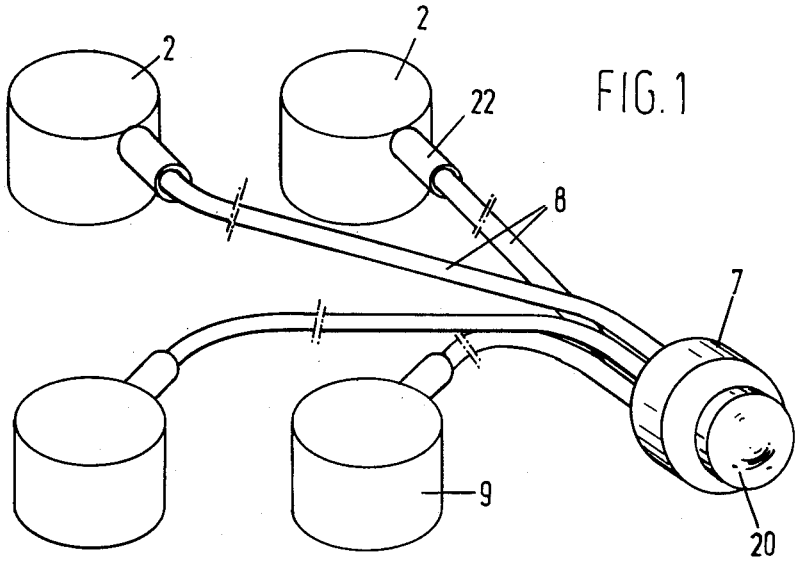
FIG. 1
FIG. 1a
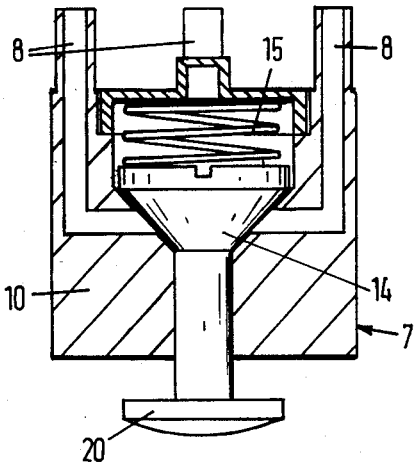

FIG. 3
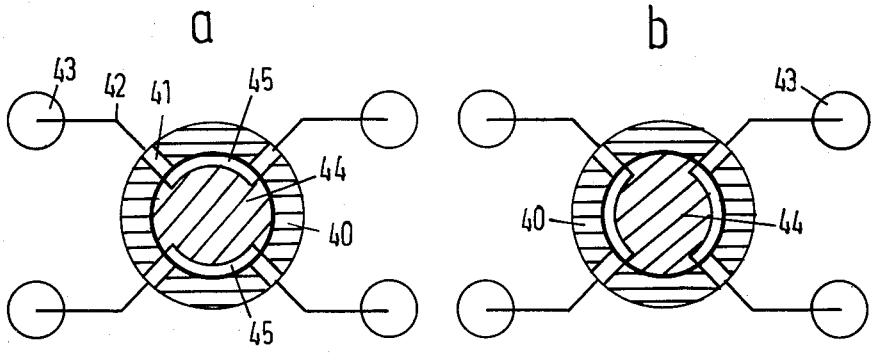
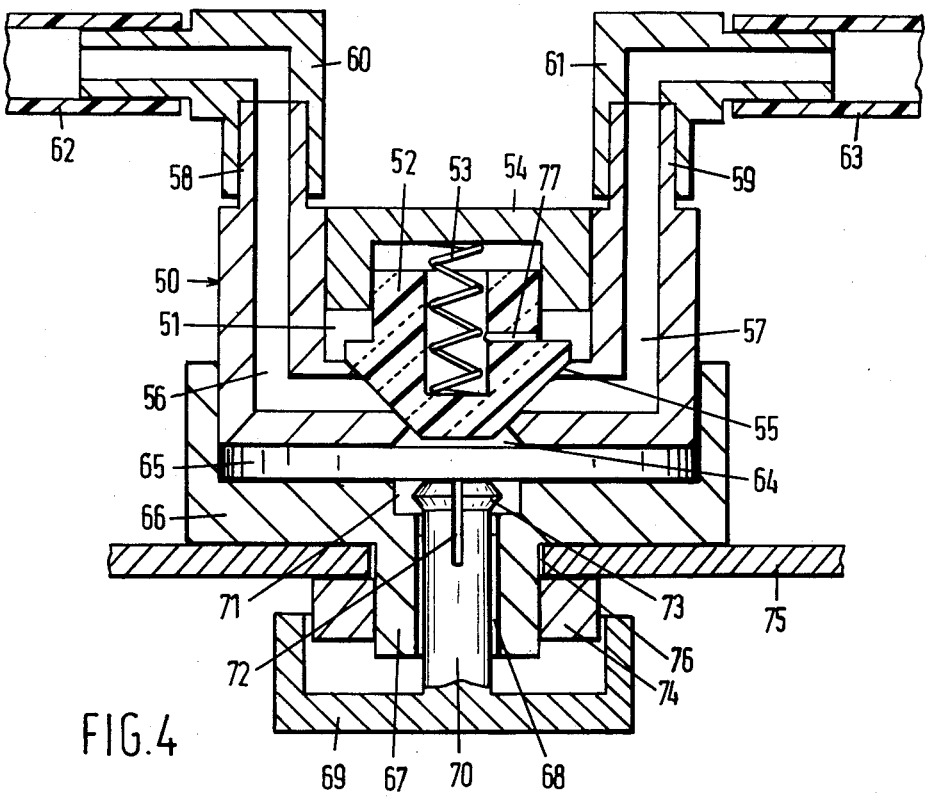
FIG. 4

QUICK LEVELING APPARATUS

The present invention relates to an apparatus for leveling a surface, e.g. of a table.

It is known that a great many apparatuses have to be leveled accurately for a proper operation.

It is an object of the present invention to provide an easily handled apparatus for accurately leveling objects. To this effect, an apparatus for leveling a surface, e.g. of a table is provided with at least three bellows containing a pressure medium, each being connected through a conduit to a central operating block adapted to selectively interconnect two or more conduits. Such an apparatus makes it possible to easily set up the object level, while using the spirit level present on the object or a loose spirit level.

The apparatus forms an entirely closed system which is maintenance-free: The closed system ensures that no or hardly any wandering occurs during a prolonged period of time.

In a further embodiment of the invention, the central operating block may be provided with a chamber in a conical wall of which the said conduits terminate, and which chamber accommodatesa spring-loaded valve fitted with a corresponding conical portion, one end of said valve extending beyond the casing. As a result, all bellows communicating with said operating block can be brought in the desired position simultaneously. The form of the operating block described has the advantage that if either of the conduit openings is not properly shut off by the valve, the liquid will leak downwardly along the valve, thus pressing the valve more firmly still on the seat; this is a result of the difference in surface.

Use can also be made of a central operating block suitable for separately controlling the supporting position in either of the two main directions, so that the placing in the desired position in either of the main directions can be effected more easily. The central operating block may be provided with a casing wherein the closable conduits, spaced at regular intervals, terminate and in which casing there is arranged a rotary slide fitted with such recesses that the conduits are either not in open communication with each other or are in open communication with each other two by two.

To ensure that even after leakage between the circumference of the spring-loaded valve and the inner wall of the chamber, operation of the valve remains possible, the chamber wall opposite the conical wall has a recessed portion or recess which is separated from the chamber by a diaphragm.

As a result, the valve can be lifted off its seat, so that two or more conduits can be interconnected.

The above described apparatus may be accommodated in a box-shaped supporting table, thereby obtaining an easily handled element for supporting e.g. scales or the like.

In the apparatus described hereinbefore, the bellows may be surrounded by a casing consisting of two telescopically coacting portions, one of which being fitted with a supporting member adapted for coaction with table attachment means.

The operating block may also be designed such that the opening in the conical wall is shut off by a diaphragm at the exterior of which there is arranged a valve operating member, and the valve made of slightly compressible material is supported against a cover, with interposition of a spring, while the conical portion of the valve has a larger diameter than the opposite portion which is slidingly received in a cover recess and which portion, adjacent the conical portion, is fitted with an equalizing passage.

This arrangement produces an operating block wherein the chance of leakage is minimized.

In order to prevent internal contamination of the bellows or pistons, these may be filled with distilled water to which an antifreeze agent has been added to prevent it also from being frozen.

The apparatus according to the invention is suitable in particular for supporting scales used by the ambulant commerce, requiring a frequent leveling of the scales.

It will be clear that the apparatus according to the invention is also suitable for setting up a surface at a slight angle relative to the horizontal, as sometimes required e.g. with a slide projector or the like.

Some embodiments of the supporting apparatus according to the invention will now be described, by way of example, with reference to the accompanying drawings, in which:

FIG. 1 is a perspective view of an apparatus for supporting objects;

FIG. 1A is a longitudinal section of a central operating block employed in the apparatus shown in FIG. 1;

FIG. 3 is a diagrammatic view of an operating block for either not connecting conduits or connecting conduits two by two, and FIG. 4 shows a different embodiment of the central operating block.

Figure 2:
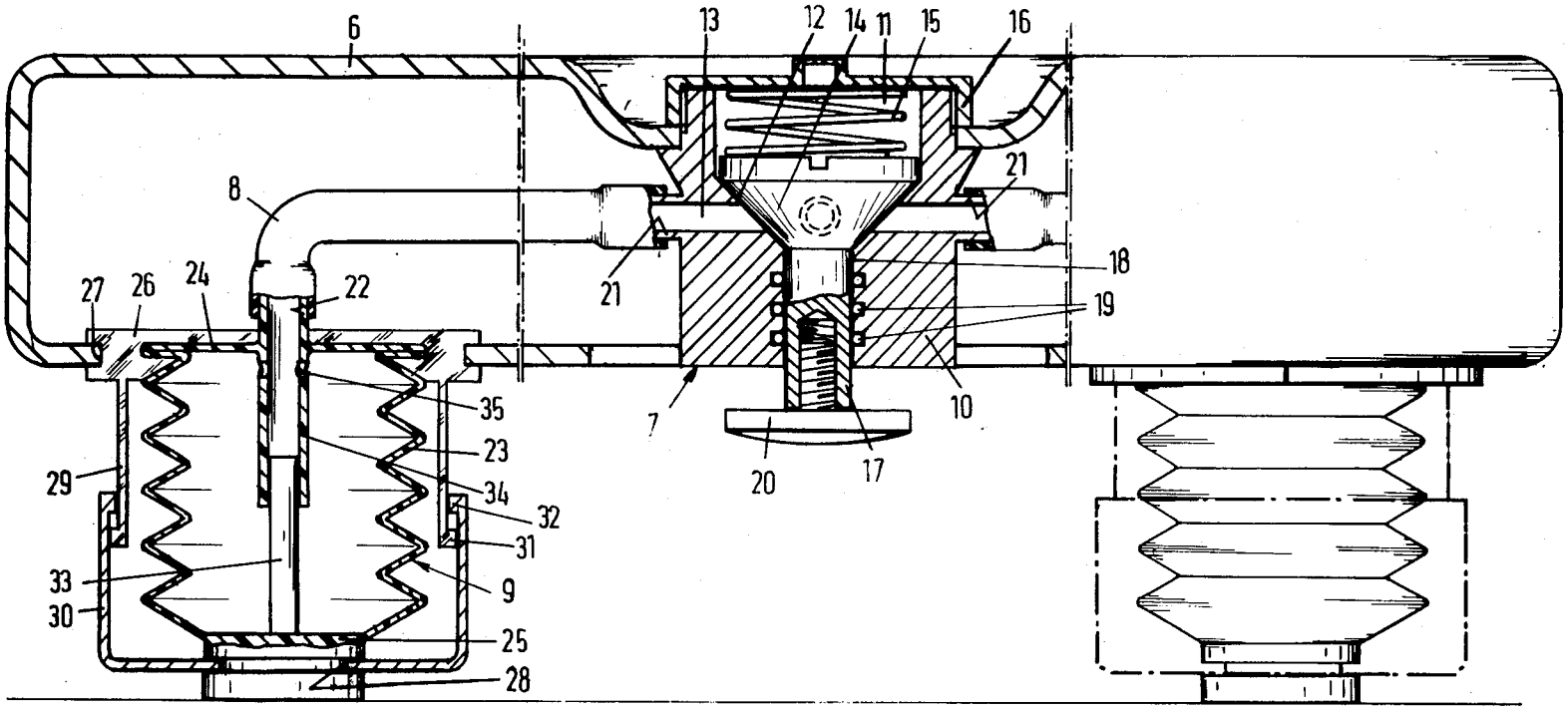
FIG. 2 is a partial view and partial cross-sectional view of an embodiment of a table leveling apparatus.

According to FIG. 1, an apparatus for supporting objects comprises four bellows, each having a stub 22. The bellows 2 are each connected through conduits 8 to a central operating block 7, fitted with a control knob 20.

As shown in FIG. 1A the central operating block 7 comprises a casing 10 wherein there is provided a chamber 11 fitted with a conical wall 12. Adjacent said conical wall 12 there terminate a plurality of passages 13 corresponding with the number of bellows 9, the conduit 8 being connected to said passages. In the chamber 11 there is arranged a conical valve 14, which is kept in abutment with the conical wall or seat 12 by means of a spring 15.

The spring finds support against a screw cover 16 closing the chamber 11. The valve 14 is fitted with a stem 17 extending through a passage 18 of the casing, whose portion projecting from the casing is fitted with said control knob 20.

To prevent leakage along the stem, the stem passageway 18 is fitted with a plurality of packing rings 19, in this case three.

As shown in FIG. 1A (and also FIG. 2), the screw cover 16 is fitted with a recessed portion 46, covered by a diaphragm 47. As a result, it remains possible, even if the space of the chamber wherein the spring 15 is disposed is entirely filled with oil, to push the conical valve 14 off its seat.

The above described apparatus may be used both in loose design and be incorporated in existing apparatus. Another possibility is shown in FIG. 2, wherein the apparatus described is accommodated in a box-shaped table top 6. Since a major portion of the means employed therefor are identical to the above described means and, consequently, are shown with the same reference numerals, a description thereof will be omitted. For the rest, the following is observed regarding FIG. 2.

The operating block 7 is accommodated in a recessed portion of the table top 6, thereby obtaining a flat top surface. As shown in the left-hand part of FIG. 2, the bellows 9 comprises the concertina-like bellows portion 23 proper, which is closed at the top end by a wall 24 and at the bottom end by a wall 25. The wall 24, together with a small part of the bellows portion 23, is fixedly received in an attachment disc 26 fitted with a recess 27 adapted for coaction with a corresponding recess in the plate-like table top 6.

The comparatively thick bottom wall 25 of the bellows 9 is fitted with a recess 28 adapted for coaction with a recess of a jacket 30. This thick synthetic plastics bottom wall 25 operates in a vibration damping fashion. It can therefore also be designed as a separate rubber disc.

The attachment disc 26 is fitted with a depending jacket 29 adapted for coaction with the said jacket 30 attached to the bottom wall 25.

The jackets 29 and 30 are fitted for relative guidance with inwardly oriented edges 31, 32. The bottom wall 25, as shown in the drawings, is further fitted with a stem 33 coacting with an inwardly extended portion 34 of the stub 22. In order to obtain a fluid connection between the conduit 8 and the interior of the bellows 9, the said portion 34 is fitted at the top wall 24 with passages 35.

In the construction shown, the bellows portion 23 proper and the bottom wall 25 together with the stem 33 are in a single piece. This is also the case with the top wall 24 with the stub 22 and the downwardly extension 34 thereof. These two portions may be interconnected e.g. by glueing and be kept firmly against one another by incorporation of the connecting portion in the attachment disc 26.

The operation of the apparatus shown in FIG. 2 will be clear: By pushing in the control knob 20, the valve 14 is lifted off its seat so that all conduits 8 are brought in open communication with each other, resulting in self-adjustment of the bellows, depending on the eveness of the foundation on which they find support and the desired position of the table. After completion of the said adjustment, the control knob is again released, so that the conduits 8 are closed. Said adjustment may take place e.g. by means of one or more leveling instruments (leveling instruments are statutory in the Netherlands e.g. with scales).

In the second embodiment diagrammatically shown in FIG. 3, use is made of a cylindrical, central operating block 40 fitted with four passages 41, each communicating through a conduit 42 with a bellows 43. In the cylindrical casing 40 there is received a plug 44 fitted with two slots 45: The slots are designed so that two passages 41 can be interconnected. In FIG. 3*a* the two upper, and the two lower passages, respectively, are interconnected, while in FIG. 3*b* the two left-hand passages, and the two right-hand passages, respectively, are interconnected. When the plug 4 is turned in an intermediate position there is no connection between the various passages and hence a stable condition is attained.

The operating block shown in FIG. 4 essentially comprises a casing 50 in a chamber 51 of which there is received a valve 52 made of a slightly compressible material, which valve 52 is maintained in abutment with a conical seat 55, with interposition of a spring 53 finding support against a cover 54. In the conical seat 55 there terminate passages 56, 57 having stubs 58, 59 connecting via bends 60, 61 to hoses 62, 63, which are comparable to the above described conduits 3 and 4.

As shown in FIG. 4, the front of the conical valve 52 extends into an opening 64 of the casing 50. The opening 64 is shut off by a diaphragm 65 retained by a cover 66. Said cover is fitted with a neck 67 through which there is provided an opening 68 for the passage of the stem 70 of a control knob 69. The opening 68, at the side of the diaphragm, terminates in a chamber 71 for receiving the enlarged head 73 of the stem 70 fitted with saw cuts 72 for assembly purposes.

The operating block shown is further attached by means of a nut 74 by champs to a wall 75 having an opening 76 of an apparatus, not further shown.

In order to achieve a rapid pressure equalization around the valve 52 in the chamber 51, the valve is fitted with an equalizing passage 77.

Although not indicated, the various above described parts of the operating block can be interconnected by means of thread, adhesive or the like. The only condition therefor is that the connection should be entirely leak-tight.

The operation of the operating block will be clear: When the position of the apparatus or wall 75 is to be changed, the control knob 69 is pushed in, thus interconnecting the passages 56 and 57. Even if the chamber 51 is entirely filled with oil, operation of the valve remains possible, since the valve is made of slightly compressible material and is fitted with an equalization passage 77.

The apparatuses described in the above have the advantage that they enable a rapid operation. Besides, they provide a good vibration damping, while a further advantage is that, due to the use of a closed system, this system is maintenancefree and is not troubled with wandering supports.

Finally, it is observed that a great many modifications are possible without departing from the scope of the invention.

I claim:

1. Apparatus for leveling a surface, comprising at least three bellows means for supporting said surface, each said bellow means containing a pressure medium;

a casing having a casing wall provided with an opening therein, and a diaphragm closing said opening;

a chamber inside said casing and having a chamber wall provided with an opening adjacent said casing wall opening, a valve member mounted in said chamber, spring means urging said valve member to a closed position in which said valve member engages said chamber wall, closes said chamber wall opening and extends into said casing wall opening;

a conduit connected between each said bellows means and said casing, at least two of said conduits being in communication with one another when said valve member is urged against the bias of said spring means out of engagement with said chamber wall, said valve member being operable to disconnect said conduits from one another when in the closed position; and a reciprocable actuator for said valve member mounted on the outside of said casing adjacent said diaphragm and arranged to be pushed into engagement with said valve member via said diaphragm and to move said valve member against the bias of said spring means out of engagement with said chamber wall.

2. Apparatus according to claim 1, wherein said conduits are arranged such that the position of the surface can be controlled in either of the two main directions.

3. Apparatus according to claim 1, wherein said chamber has a second wall opposite to said chamber wall having said opening, said second chamber wall being provided with a recess closed by a diaphragm member.

4. Apparatus according to claim 1, wherein said valve member is made of slightly compressible material.

5. Apparatus according to claim 4, wherein said valve member has a conical portion that closes said chamber wall opening.

6. Apparatus according to claim 5, wherein said conical portion has a cylindrical portion of smaller diameter extending from the base of the conical portion, said cylindrical portion having passage means for equalizing pressure around said valve member in said chamber.

7. An apparatus according to claim 1, disposed in a box-shaped supporting table.

8. An apparatus according to claim 1, wherein the bellows is surrounded by a casing consisting of two telescopicaly coacting portions.

9. An apparatus according to claim 8, characterized in that the one portion of said telescopic casing portions is fitted with a supporting member adapted for coaction with table attachment means.

10. An apparatus according to claim 1 characterized in that the bellows are fulfilled with distilled water by which an antifreeze agent has been added.

* * * * *